US006192875B1

(12) United States Patent
Koroku et al.

(10) Patent No.: US 6,192,875 B1
(45) Date of Patent: Feb. 27, 2001

(54) CORE BIT

(75) Inventors: Shuichirou Koroku; Tamotsu Nakano; Eiji Adachi, all of Fujieda (JP)

(73) Assignee: Osaka Diamond Industrial Co., Sakai (JP)

( * ) Notice: Subject to any disclaimer, the term of this patent is extended or adjusted under 35 U.S.C. 154(b) by 0 days.

(21) Appl. No.: 09/214,803

(22) PCT Filed: Jun. 5, 1998

(86) PCT No.: PCT/JP98/02522

§ 371 Date: Jan. 12, 1999

§ 102(e) Date: Jan. 12, 1999

(87) PCT Pub. No.: WO98/56553

PCT Pub. Date: Dec. 17, 1998

(30) Foreign Application Priority Data

Jun. 11, 1997 (JP) ..... 9-191738

(51) Int. Cl.[7] ..... B28D 1/02

(52) U.S. Cl. ..... 125/20; 451/540; 451/541

(58) Field of Search ..... 125/13.01, 12, 125/15, 22, 20; 451/540, 541, 542

(56) References Cited

U.S. PATENT DOCUMENTS

| | | | | |
|---|---|---|---|---|
| 3,153,885 | * | 10/1964 | Keller et al. | 125/20 |
| 4,208,154 | * | 6/1980 | Gundy | 125/20 |
| 4,667,755 | * | 5/1987 | Muler et al. | 125/20 |
| 4,911,253 | * | 3/1990 | Cliche | 125/20 |
| 5,004,382 | * | 4/1991 | Yoshino | 125/20 |
| 5,011,514 | * | 4/1991 | Cho et al. | 51/295 |
| 5,069,584 | * | 12/1991 | Obermeier et al. | 125/20 |
| 5,096,465 | * | 3/1992 | Chen et al. | 51/295 |
| 5,151,107 | * | 9/1992 | Cho et al. | 51/295 |
| 5,823,275 | * | 10/1998 | Ku et al. | 125/20 |

FOREIGN PATENT DOCUMENTS

| | | | | |
|---|---|---|---|---|
| 276271 | * | 8/1927 | (EP) | 125/20 |
| 686372 | * | 1/1953 | (EP) | 125/20 |
| 62-126909 | | 8/1987 | (JP) . | |
| 2160505 | | 6/1990 | (JP) . | |
| 3-84110 | | 8/1990 | (JP) . | |
| 3-7470 | | 1/1991 | (JP) . | |
| 3245974 | | 11/1991 | (JP) . | |
| 5329833 | | 12/1993 | (JP) . | |
| 9-070817 | | 3/1997 | (JP) . | |

* cited by examiner

*Primary Examiner*—Derris H. Banks
(74) *Attorney, Agent, or Firm*—W. F. Fasse; W. G. Fasse

(57) ABSTRACT

A core bit includes a tube (2) having an opening end surface (21) in the axial direction and a plurality of tips (3) fixed to the opening end surface (21) of the tube (2). Each of the tips (3) includes an abrasive grain layer (31) that contains diamond abrasive grains and a binder for bonding the diamond abrasive grains to each other. The diamond abrasive grains contain not more than 0.03 weight % of inclusions. The inclusions contain iron and nickel as main components. The binder contains at least 0.1 weight % and not more than 2.0 weight % of graphite. The core bit has a short perforation time, i.e., a high cutting speed, excellent sharpness, excellent durability, and a long life. The core bit is suitable for boring a concrete structure.

20 Claims, 11 Drawing Sheets

CORE BIT

TECHNICAL FIELD

The present invention relates to a core bit, and more specifically, it relates to a core bit serving as a tool employed for a cutting or excavating operation for boring a concrete structure of reinforced concrete or the like, mortar, brick, rock, asphalt or the like.

BACKGROUND TECHNIQUE

A core bit employed for boring a concrete structure or the like has a cylindrical tube and diamond tips fixed to an opening end surface of the tube at regular intervals in the circumferential direction. The core bit is rotated and driven by a motor or the like for pressing the opening end surface of the tube against a surface of the concrete structure or the like, thereby boring the concrete structure or the like while cutting an annular groove in the surface thereof.

Such a core bit is classified into a wet-type core bit employing cooling water in a perforating operation and a dry-type core bit with air cooling airflow for performing cooling by feeding an airflow.

The wet-type core bit is capable of cutting with a heavy load, and hence has high productivity. When employing the wet-type core bit, however, there arise such a problem that the consumption of energy is high and such an environmental problem that the cooling water contaminates the workpiece. In the dry-type core bit, on the other hand, the environmental problem of contaminating the workpiece is small since no cooling water is employed. When employing the dry-type core bit, however, end surfaces of the diamond tips involved in cutting are heated to a high temperature, and hence the dry-type core bit has such a disadvantage that the tool life thereof is short or the like.

However, since an operation for boring a concrete structure such as a building material is generally performed at the so-called work site in a place where a building structure is present and hence it is difficult to secure cooling water, the convenient dry-type core bit is mainly employed.

FIG. 1 is a partial sectional view showing a perforation apparatus including a core bit and a concrete structure selected as a workpiece in a perforating operation employing a dry-type core bit. As shown in FIG. 1, the core bit has a tube 2, a flange 1 fixed to one end of the tube 2, and a plurality of tips 3 fixed to the other end of the tube 2. The plurality of tips 3 are fixed to an opening end surface of the tube 2 at regular intervals along the circumferential direction. A perforation apparatus 10 is mounted on the flange 1 of the core bit. The perforation apparatus 10 has an axial hole 5 so that compressed air circulates therethrough as shown by arrows. Forward end surfaces of the tips 3 are pressed against a surface 41 of the concrete structure 4 while rotating and driving the core bit with the perforation apparatus 10. Thus, a perforating operation is performed to form an annular groove 42 in the concrete structure 4. At this time, the compressed air is introduced into the tube 2 through the axial hole 5, passes through the annular groove 42, reaches the outer side of the tube 2 through the forward end surfaces of the tips 3, and passes through the annular groove 42 again to be effused into the air, as shown by arrows. Cooling of the tips 3 and discharge of chips resulting from cutting of the concrete structure 4 are performed by this airflow.

Each one of the tips 3 consists of an abrasive grain layer. The abrasive grain layer is formed by diamond abrasive grains and a metal bond serving as a binder for bonding the diamond abrasive grains to each other. The metal bond is mainly composed of hard grains of tungsten or the like and cobalt. Tips structured in such a way are frequently employed in general, and are of a type of diamond abrasive grains mixed into a metal bond. A core bit having tips of such a type is called an impregnated bit. When employing a core bit of this type, an autogenous action successively provides new surfaces of diamond abrasive grains during the perforation operation as wear of the diamond tips progresses by chips.

In case of performing a boring operation in a dry type with an impregnated bit, forward end surfaces of tips are strongly pressed against a surface of a concrete structure. In this case, the amount of heat generated by the friction between the tips and the concrete structure is significant in contrast to the case of the wet type operation employing cooling water. Further, a cylindrical groove formed by cutting the concrete structure is narrow and small, and hence compressed air cannot smoothly flow in the groove. Thus, a cooling effect with the compressed air is weak, and hence parts of the diamond tips concerned in cutting are heated to a high temperature.

The diamond abrasive grains start to be thermally damaged when heated to at least 600° C. in the air. When the diamond abrasive grains are heated to at least 900° C., further, the diamond abrasive grains are gasified, crushed or worn before the metal bond is worn. Consequently, the autogenous action of the diamond abrasive grains is inhibited in the perforating operation, and the core bit cannot perform cutting. In case of employing the conventional core bit, therefore, it has been impossible to increase the perforating speed by strongly pressing the forward end surfaces of the diamond tips against a surface of a workpiece.

In order to enable the autogenous action of the diamond abrasive grains to continuously take place, therefore, an easily worn substance may be employed as the material for the metal bond. However, there has been such a problem that the diamond tip itself becomes fragile and the strength lowers when employing an easily worn substance as the material for the metal bond.

As another means for enabling the autogenous action of the diamond abrasive grains to continuously take place, the tip may be reduced in size for reducing the number of the diamond abrasive grains, in order to increase a load applied to the diamond abrasive grains. When employing this means, however, there have been such problems that not only does the strength of the tip decrease, but also vibration increases in a perforating operation particularly while cutting a reinforcing bar or the like. As a result, diamond abrasive grains crush or fall at an increased rate, and the tip is worn in an early stage.

An object of the present invention is to provide a core bit having a high cutting speed, i.e., excellent sharpness, being excellent in durability, and having a long life.

DISCLOSURE OF THE INVENTION

A core bit according to the present invention has a tube having an opening end surface in the axial direction, and a plurality of tips fixed to the opening end surface of the tube. Each tip includes an abrasive layer. The abrasive layer contains diamond abrasive grains and a binder for bonding the diamond abrasive grains to each other. The diamond abrasive grains contain not more than 0.03 weight % of inclusions, and the inclusions contain iron (Fe) and nickel (Ni) as main components. The binder contains at least 0.1 weight % and not more than 2.0 weight % of graphite.

At this point, "inclusions" means solvent metals such as iron (Fe), nickel (Ni), cobalt (Co), chromium (Cr), manganese (Mn), and the like that are added as catalysts when preparing diamond and that remain the final product of diamond abrasive grains.

In consequence of various tests and researches, the inventors have completed a core bit having the aforementioned structure on the basis of the following recognition:

Namely, in a perforating operation employing a dry-type core bit, it is impossible to avoid such a state that forward end surfaces of diamond tips involved in cutting are heated to a high temperature. Considering such a situation that sparks come off during cutting and damaged situations of the forward end surfaces of the diamond tips involved in cutting, it is conceivable that the forward end surfaces of the diamond abrasive grains are heated to at least 900° C., or at least 1100° C. as the case may be.

When heated to such a high temperature, the diamond abrasive grains may be carbonated or influence by impurities contained in the diamond abrasive grains may causes deterioration of physical properties of the diamond abrasive grains. As a result, the high-temperature strength of the diamond abrasive grains in particular decreases.

In air heated to a high temperature, on the other hand, the diamond abrasive grains are damaged because the aforementioned mechanical physical property deterioration of the diamond abrasive grains and also chemical change from oxidizing action on diamond that results in carbon dioxide take place at the same time.

In the present invention, therefore, diamond abrasive grains having high high-temperature strength are selected and used by applying selection conditions for the diamond abrasive grains with respect to such mechanical physical property deterioration that lowers the high-temperature strength of the diamond abrasive grains. Thus, the solvent metals serving as catalysts employed in preparation of the diamond abrasive grains are specified and the content of inclusions contained in the diamond abrasive grains by the solvent metals is limited.

In the present invention, further, the material for diamond tips is so structured that the atmosphere around the diamond tips involved in cutting is non-oxidative in the space of a narrow and small annular groove formed with progress of cutting, to prevent chemical deterioration of the diamond abrasive grains resulting from such a phenomenon that diamond is oxidized to form carbon dioxide.

First, the value of TTI (Thermal Toughness Index) determined by a pot mill method is generally employed as the reference for selecting diamond abrasive grains having high high-temperature strength.

A method of measuring the value of TI (Toughness Index) is now described. In case of employing diamond abrasive grains of #40/#50 (grain size: 425 to 300 $\mu$m) in particle size, the value of TI is measured as follows: First, diamond abrasive grains of 15 ct (carats) are introduced into a sieve of #40/#50, and sieved with a sieve machine for one minute. Thereafter 2 ct of diamond abrasive grains are weighed. These diamond abrasive grains and a steel ball of 7.94 mm in diameter are introduced into a crushing test container, set on a vibration tester and vibrated for 50 seconds. The vibrated diamond abrasive grains are introduced into the sieve of #40/#50, and sieved with the sieve machine for one minute. The toughness index is calculated from the weight of the diamond abrasive grains thus treated in accordance with the following expression:

TI (toughness index)={(weight of diamond abrasive grains finally remaining on sieve)/(weight of the aforementioned diamond abrasive grains of 2 ct)}×100 (%)

The size of the steel ball employed in the above and the vibrating time vary with the size of the diamond abrasive grains.

The value of TTI is a value obtained by measuring TI after heat treatment of the diamond abrasive grains.

FIG. 2 is a diagram showing a heat treatment hysteresis in a case where diamond abrasive grains are heat-treated at a heat treatment temperature exceeding 800° C., and FIG. 3 is a diagram showing a heat treatment hysteresis in a case where diamond abrasive grains are heat-treated at a heat treatment temperature of not more than 800° C. The heat treatment is performed in a nitrogen gas atmosphere.

The toughness index is measured through the aforementioned procedure with diamond abrasive grains thus heat-treated at a prescribed heat treatment temperature. For example, TTI (high-temperature toughness index) of diamond abrasive grains heat-treated at 1100° C. is expressed as TTI (1100° C.) (%).

In general, high-temperature strength of diamond abrasive grains has been evaluated through the value of the aforementioned TTI. As to diamond abrasive grains employed under severe use conditions such as those for the diamond tips of the core bit according to the present invention, however, it has been difficult to select diamond abrasive grains appropriate for preventing mechanical physical property deterioration of the diamond tips only with the value at whichever temperature of 800 to 1200° C. the value of TTI is noted.

Then, the inventors have obtained such knowledge that diamond abrasive grains having high high-temperature strength can be selected by specifying the main components of the inclusions of the diamond abrasive grains, i.e., the main components of the solvent metals, and the content of the inclusions according to the present invention. In other words, it has been recognized that the high-temperature strength is low when the main components of the inclusions in the diamond abrasive grains are iron and cobalt or nickel and manganese, while the high-temperature strength is high when the main components are iron and nickel. Further, it has been recognized that diamond abrasive grains having high-temperature strength necessary for preventing mechanical physical property deterioration of the diamond tips are obtained when the inclusion content in the diamond abrasive grains is not more than 0.03 weight %.

Then, inert gas such as nitrogen gas may be fed around the diamond tips in place of compressed air, in order to render the atmosphere non-oxidative around the diamond tips involved in cutting. However, it is difficult to secure such a gas source at the site of a perforating operation. Further, it is difficult to feed such inert gas up to the vicinity of forward end surfaces of the diamond abrasive grains being in contact with a surface of a concrete structure in the space of an annular groove formed with progress of cutting.

Thereupon, the inventors have obtained such knowledge that particles of graphite present on a surface of the metal bond are oxidized at a temperature lower than that at which the diamond abrasive grains are oxidized, e.g., a temperature from 500° C. to 600° C. by mixing a proper amount of graphite into the metal bond. Thus, new particles of graphite are exposed as the metal bond is worn and change to carbon dioxide due to oxidative reaction, and as a result carbon dioxide is continuously generated in the atmosphere around the forward end surfaces of the diamond tips during the perforating operation. Therefore, a cylindrical sheath of carbon dioxide is formed in a cylindrical groove formed in the process of cutting, and the core bit rotates in the cylindrical sheath. Consequently, the atmosphere around the forward end surfaces of the diamond tips regularly contains carbon dioxide.

While it is desirable to form a complete oxygen-free state in the atmosphere around the diamond tips at this time, this is not necessary in practice. This is because it is enough if oxidation of the diamond abrasive grains in the air is suppressed to a degree that will enable the use of the diamond tips in practice.

While a shielding effect of the carbon dioxide against oxygen contained in the air is excellent when the amount of addition of graphite into the metal bond is large, the amount of addition of graphite is limited for the following reason: If the content of graphite in the metal bond is not more than 0.1 weight %, not only is the amount of generated carbon dioxide insufficient, but the graphite does not act as a solid lubricant and as a result, seizure takes place. If the content of graphite in the metal bond exceeds 2.0 weight %, the metal bond itself becomes too fragile, and the diamond tips are too remarkably worn. Thus, the content of graphite is limited to at least 0.1 weight % and not more than 2.0 weight%.

According to the present invention, as hereinabove described, diamond abrasive grains having high high-temperature strength are employed while the perforating operation is performed in the atmosphere of carbon dioxide generated by graphite contained in the metal bond serving as a binder, and chips are continuously produced from a workpiece such as a concrete structure. In diamond tips of an impregnated bit chips of the concrete structure are produced by the diamond abrasive grains; the surface of the metal bond is worn by the chips and retreats, damaged diamond abrasive grains fall from the tips; and new surfaces of diamond abrasive grains are exposed this process must be repeatedly carried out so that autogenous action of the diamond abrasive grains continuously takes place.

It is preferable to use diamond abrasive grains of a larger grain size than the particle size #40/#50 (grain size: 425 to 300 $\mu$m) for producing the largest possible chips, so that retreat of the metal bond is excellently performed.

In the core bit according to the present invention, further, the grain size of graphite contained in the metal bond as a binder is preferably not more than 1/10 of the grain size of the diamond abrasive grains. On the surface of the metal bond of the core bit after performing the perforating operation, burnt traces of graphite are present as blackening depressions, and the portions of the depressions act also as chip pockets. When employing coarse graphite particles relative to the diamond abrasive grains, chips enlarge and the sharpness becomes excellent in case of boring a soft structure of mortar or the like. In case of boring a hard structure of concrete containing aggregate or the like, however, the transverse rupture strength of the metal bond itself decreases and the quantity of wear of the diamond tips increases. As a result, the life of the core bit serving as a tool decreases when the aforementioned coarse graphite particles are used. As hereinabove described, the grain size of the diamond abrasive grains varies with the type of the workpiece and is not necessarily unequivocally limited, while the grain size of graphite according to the present invention should be not more than 1/10 with respect to the grain size of the diamond abrasive grains since the graphite of a fine grain size acts as a solid lubricant.

Force in the normal direction received by the core bit in cutting is applied to the diamond abrasive grains. The metal bond serving as a binder for holding the diamond abrasive grains must withstand the aforementioned stress. When performing a cutting operation with the core bit in a dry type, however, it may happen that the forward end surfaces of the diamond tips involved in cutting are heated to a high temperature, the metal bond is softened by this heat and the diamond abrasive grains are press-fitted into the metal bond. Consequently, the amount of projection of the diamond abrasive grains from the surface of the metal bond reduces, and furthermore, friction between the metal bond and the surface of the workpiece increases and a heating phenomenon progresses.

Considering the aforementioned phenomenon, it is necessary that the metal bond maintains high strength also at a high temperature and excellently retreats with respect to the diamond abrasive grains, so that new surfaces of the diamond abrasive grains regularly project from the surface of the metal bond.

In order to implement this, the metal bond preferably contains at least 15 weight % and not more than 50.0 weight % of an intermetallic compound of nickel (Ni)—tin (Sn) in addition to graphite, as a binder. In more concrete terms, material powder of the intermetallic compound of nickel-tin is blended in the composition of the metal bond. The aforementioned intermetallic compound has high hardness and has low transverse rupture strength, and is hard to soften even at a high temperature. If the content of the intermetallic compound of nickel-tin is less than 15.0 weight %, necessary hardness cannot be attained at a high temperature. If the content of the intermetallic compound of nickel-tin exceeds 50.0 weight %, the metal bond becomes too fragile, the transverse rupture strength becomes too low, and cracking of the diamond tips takes place.

A binder containing at least 15.0 weight % and not more than 50.0 weight % of the intermetallic compound of nickel-tin as described above lowers, the transverse rupture strength of the metal bond. Therefore, it is preferable to form a plurality of concave parts on the opening end surface of the tube of the core bit and to fix each of the plurality of tips to respective ones of the plurality of concave parts. It is possible to compensate for reduction of the transverse rupture strength of the metal bond for preventing crushing of the diamond tips by thus fixing the tips to the opening end surface of the tube. In this case, the end surfaces of the tips preferably project by not more than 3.0 mm from the opening end surface of the tube.

Further, it is preferable to prepare the metal bond from powder containing copper (Cu), tin (Sn), nickel (Ni) and cobalt (Co) as a binder.

As one embodiment of the core bit according to the present invention, it is preferable that the degree of concentration (concentration) of the diamond abrasive grains in the abrasive grain layer is at least 20 and not more than 40 and a tip occupation rate defined by {(length of each tip along circumferential direction of opening end surface of tube)× (number of tips fixed to opening end surface of tube)/(length of opening end surface of tube along circumferential direction)}×100 (%) is at least 15% and not more than 40% in a core bit of at least 10.0 mm and not more than 150.0 mm in perforation diameter.

At this point, the degree of concentration of the diamond abrasive grains is expressed as 100 (no unit) when containing diamond of 4.4 ct (carats) in a volume of 1 $cm^3$.

As another countermeasure against reduction of the transverse rupture strength of the metal bond, the tip preferably further includes a holding layer for holding the abrasive grain layer in the core bit according to the present invention.

When the tip has the holding layer, it is possible to compensate for reduction of the transverse rupture strength of the metal bond serving as a binder. Further, vibration generated during the perforating operation, particularly while cutting a reinforcing bar or the like can be suppressed, and there is no need to provide a plurality of concave parts on the opening end surface of the tube of the core bit.

In this case, the holding layer is preferably fixed to a first end surface of the abrasive grain layer positioned in the axial direction of the tube and to a second end surface of the abrasive grain layer positioned in the circumferential direction of the opening end surface of the tube. Further, the holding layer preferably has a composition different from that of the binder and has transverse rupture strength higher than that of the abrasive grain layer. Thus, a metal bond having low transverse rupture strength can be more effectively reinforced as the binder forming the abrasive grain layer. In order to implement transverse rupture strength higher than that of the abrasive grain layer, the holding layer preferably contains cobalt (Co) or nickel (Ni).

When the tip has the holding layer, the tip occupation rate defined as described above is preferably at least 40% and not more than 80% in the meaning of preventing the cutting speed from slowing.

As hereinabove described, it is possible to bore a concrete structure or the like in a dry type operation at a high cutting speed, i.e., with excellent sharpness by employing the core bit according to the present invention. Further, the core bit according to the present invention is excellent in durability, and has a long tool life.

In addition, it is possible to prevent the abrasive grain layer of the tip from cracking by employing the core bit according to the present invention having the holding layer. The tip occupation rate increases when the holding layer is provided. Vibration generated while cutting a reinforcing bar or the like can also be prevented particularly when boring reinforced concrete or the like, and the tool life can be improved by suppressing progress of wear of the tip due to reduction of the vibration, i.e., reduction of impacts against the tip.

While the present invention has been described particularly with reference to a dry-type core bit, the structure of the present invention can be employed also with respect to a wet-type core bit, and it is effective also as a cutting tool with a heavy load.

DETAILED DESCRIPTION OF THE BEST MODE FOR CARRYING OUT THE INVENTION

EXAMPLE 1

Four types of commercially available diamond abrasive grains A, B, C and D for a saw blade said to have high high-temperature strength were prepared. The particle size of each diamond abrasive grain was (#30/#40) (grain size: 600 to 425 $\mu$m). Diamond tips consisting of abrasive grain layers were prepared by mixing material powder of a metal bond to the respective diamond abrasive grains as a binder and performing sintering. The degree of concentration (concentration) of the diamond abrasive grains in the abrasive grain layers was 34. The metal bond contained graphite by 0.5 weight %, cobalt by 19.5 weight %, nickel by 10.0 weight %, copper by 56.0 weight % and tin by 14.0 weight %. The hardness (HRB) of the metal bond was 99, and the transverse rupture strength was 45 kgf/mm$^2$.

Figure 1:
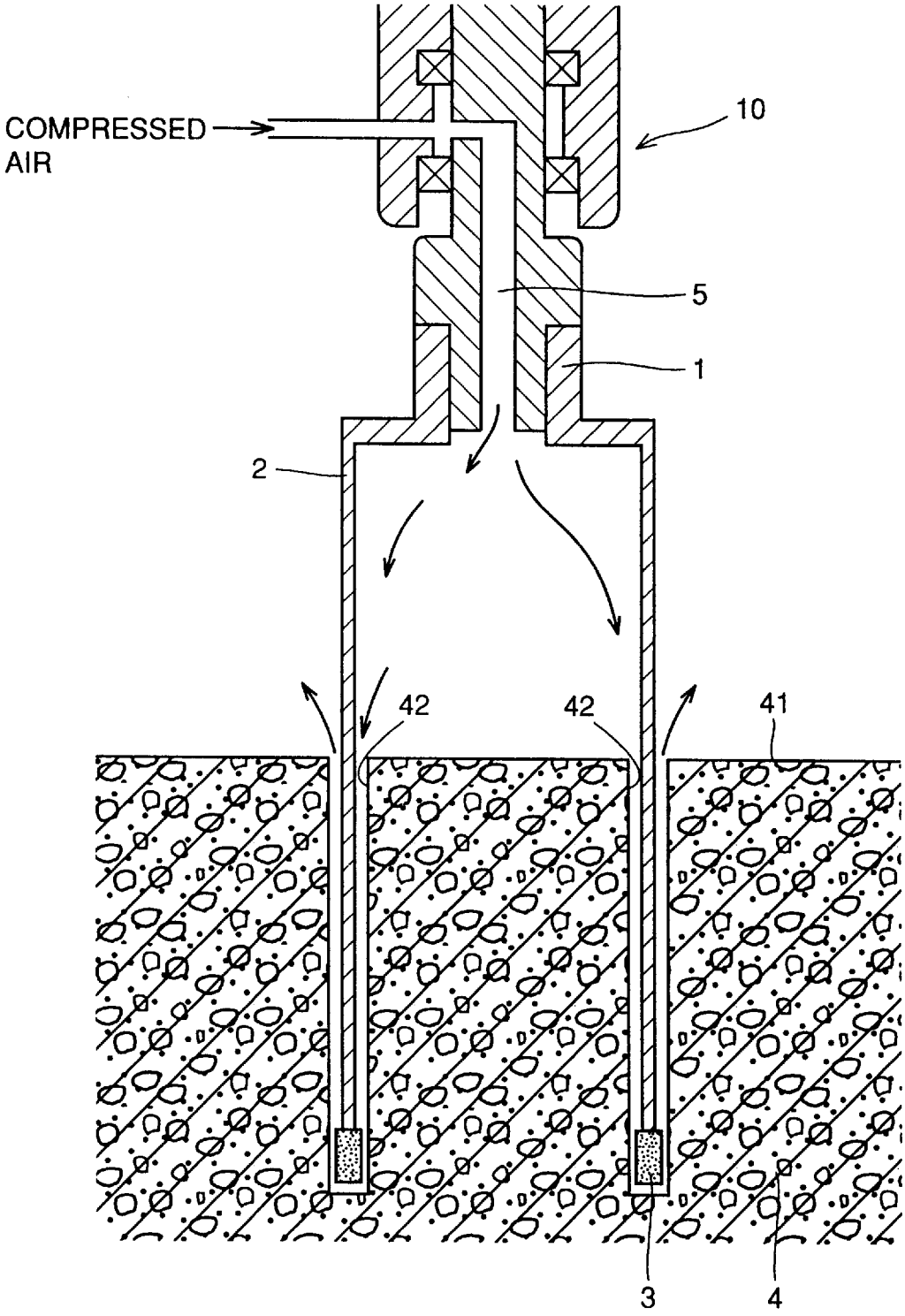
FIG. 1 PRIOR ART
FIG. 1 is a partial sectional view showing a perforation apparatus and a concrete structure employed as a workpiece in a perforating operation performed with a conventional dry-type core bit.
Figure 2:
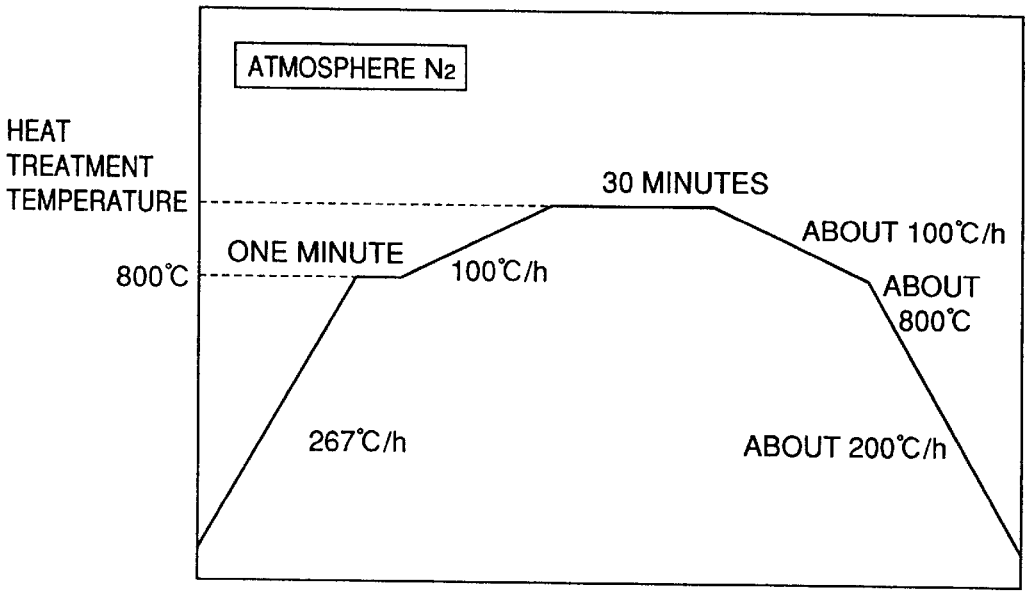
FIG. 2 is a diagram showing the hysteresis of heat treatment performed for measuring the value of TTI of diamond abrasive grains.
Figure 3:
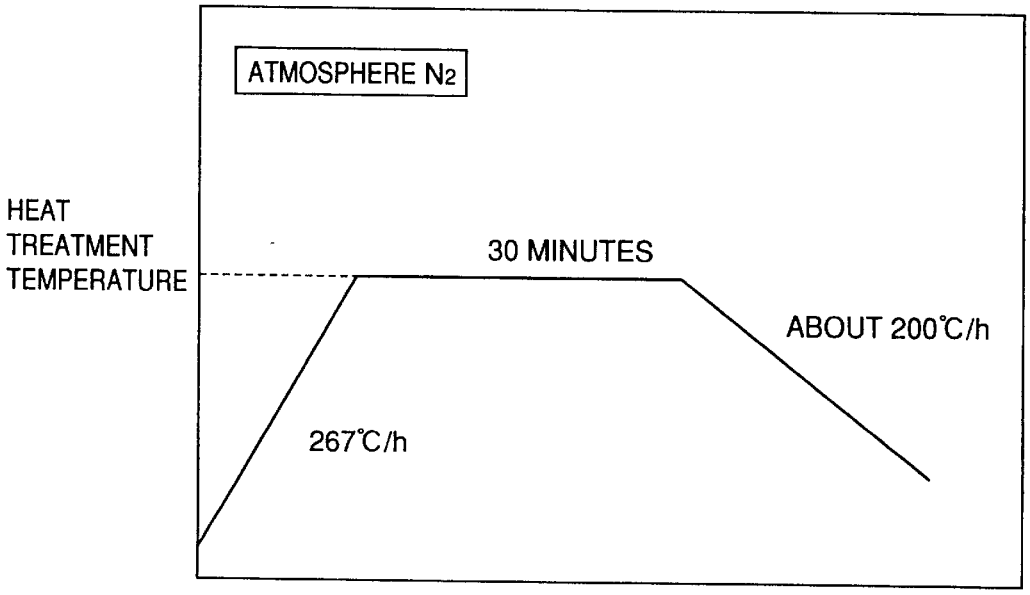
FIG. 3 is a diagram showing the hysteresis of another heat treatment performed for measuring the value of TTI of diamond abrasive grains.
Figure 4:
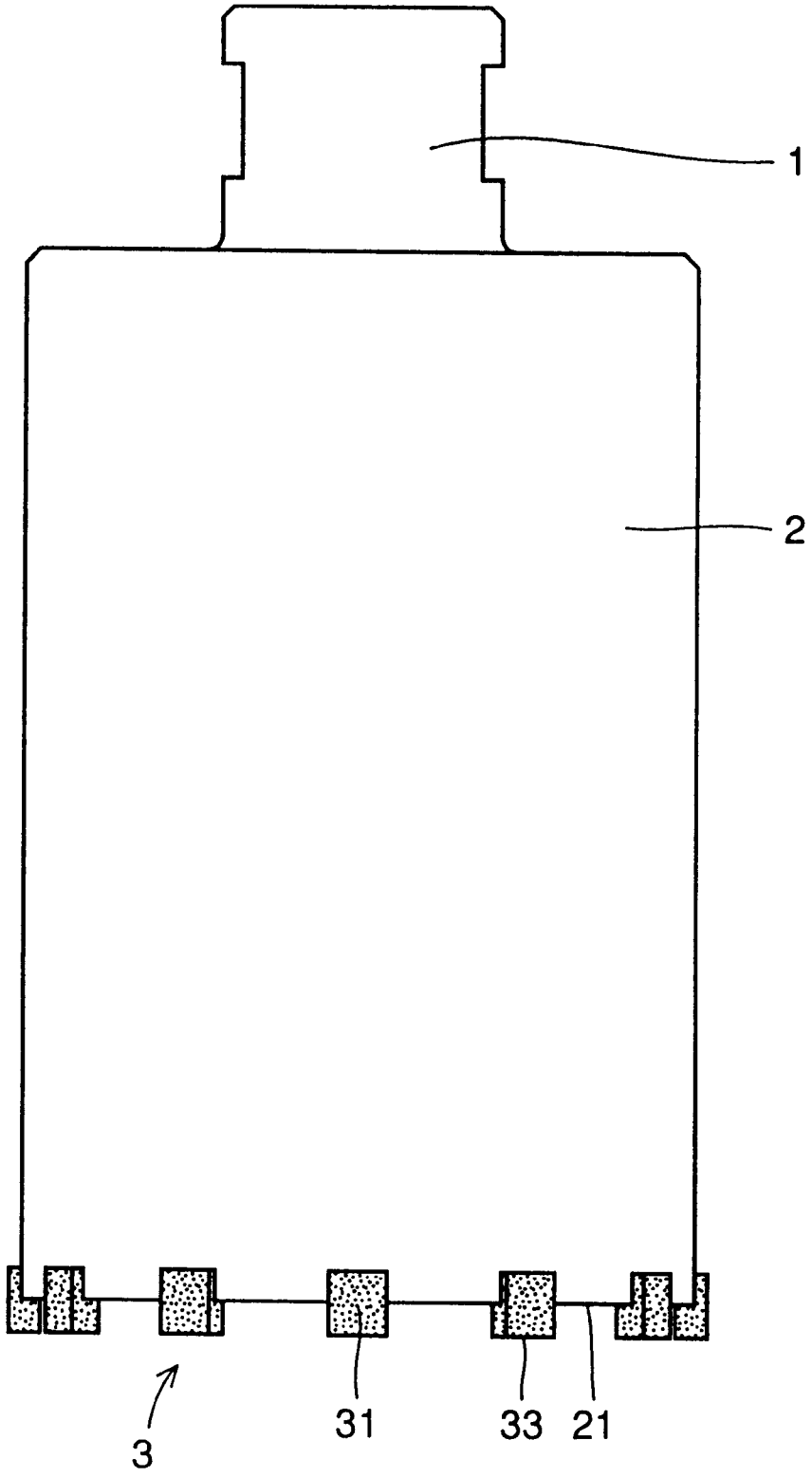
FIG. 4 is a side elevational view showing an embodiment of a core bit according to the present invention.
Figure 5:
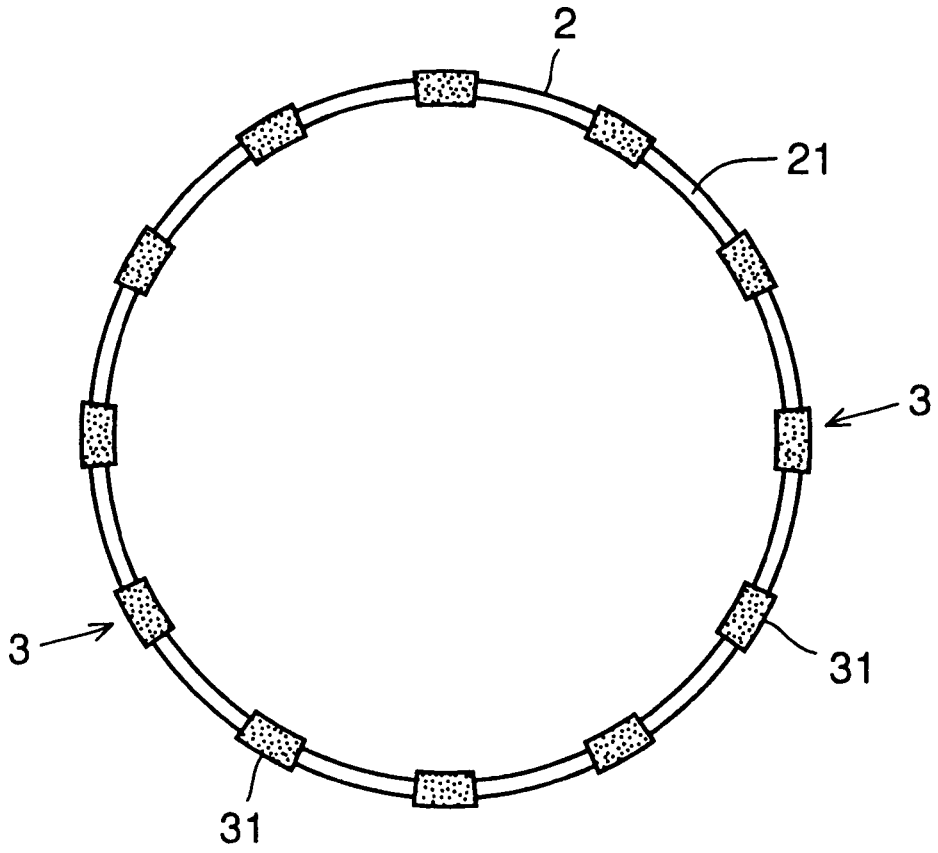
FIG. 5 is an end view showing a forward end portion of the core bit shown in FIG. 4.

A core bit was prepared by fixing the diamond tips prepared in the aforementioned manner to a tube of steel. In more concrete terms, diamond tips 3 consisting of abrasive grain layers 31 were fixed to an opening end surface 21 of a tube 2 of steel by brazing as shown in FIG. 4 and FIG. 5. In this Example, concave parts 22 were formed on the opening end surface 21 of the tube 2 for inserting the tips 3 in the concave parts and brazing the same to the tube 2 as shown in FIG. 6B, since the transverse rupture strength of the metal bond was low. The type shown in FIG. 6B is called a tip embed type. On the other hand, there is also a method of fixing the tips 3 to the opening end surface 21 of the tube 2 by brazing. The type shown in FIG. GA is called a tip projection type. When employing the tip projection type in this Example, there is a possibility that the abrasive grain layers 31 forming the tips 3 are crushed since the transverse rupture strength of the metal bond is low.

As to the specifications of the prepared core bit, the bore diameter was 65 mm, the number of the diamond tips 3 fixed along the circumferential direction of the opening end surface 21 of the tube 2 was 14, and the dimensions (length in direction along opening end surface of tube 2)×(thickness)×(height) of the diamond tips 3 were 4.0×3.5×6.0 (mm). The tip occupation rate was 27.4%. A flange 1 for mounting the core bit on a perforation apparatus was fixed to an end surface of the tube 2 opposite to the opening end surface 21.

A perforation test was made by mounting each core bit on the perforation apparatus and cutting a workpiece in a dry type. As to the specifications of the perforation apparatus, it was a hand-type electric apparatus with an electric motor capacity of 720 W and a rotational frequency of 1100 rpm. The workpiece was a sidewalk-roadway boundary block having pressure resistance of 350 kgf/cm$^2$, and the perforation depth was 130 mm. In this perforation test, it was impossible to use compressed air for cooling due to the hand-type or handheld electric apparatus. Therefore, the perforation test was made in a cooling situation with a breeze caused by motor rotation.

Figure 7:
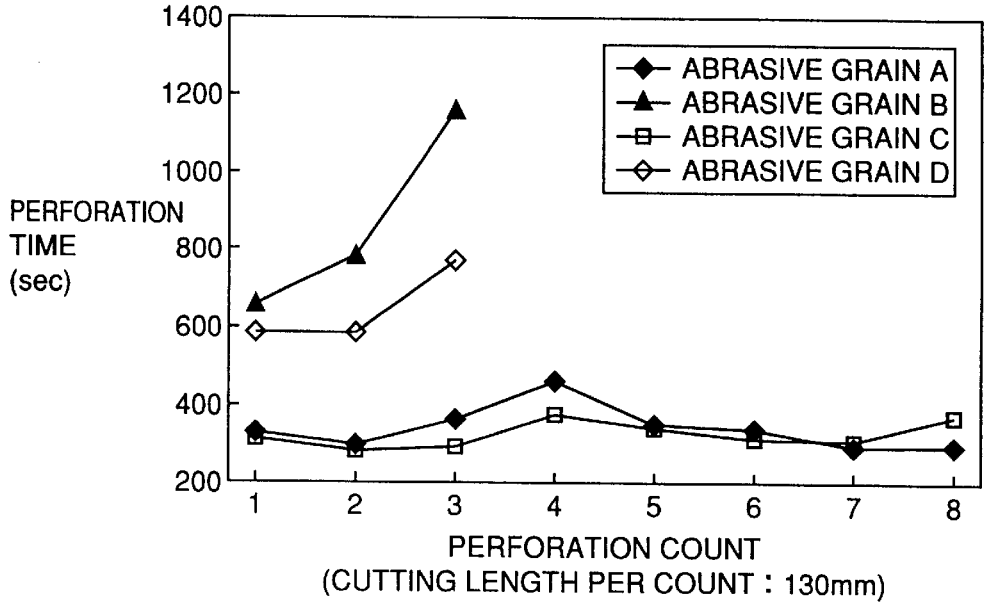
FIG. 7 is a diagram showing perforation times changing with perforation counts every type of diamond abrasive grains in Example 1.
Figure 8:
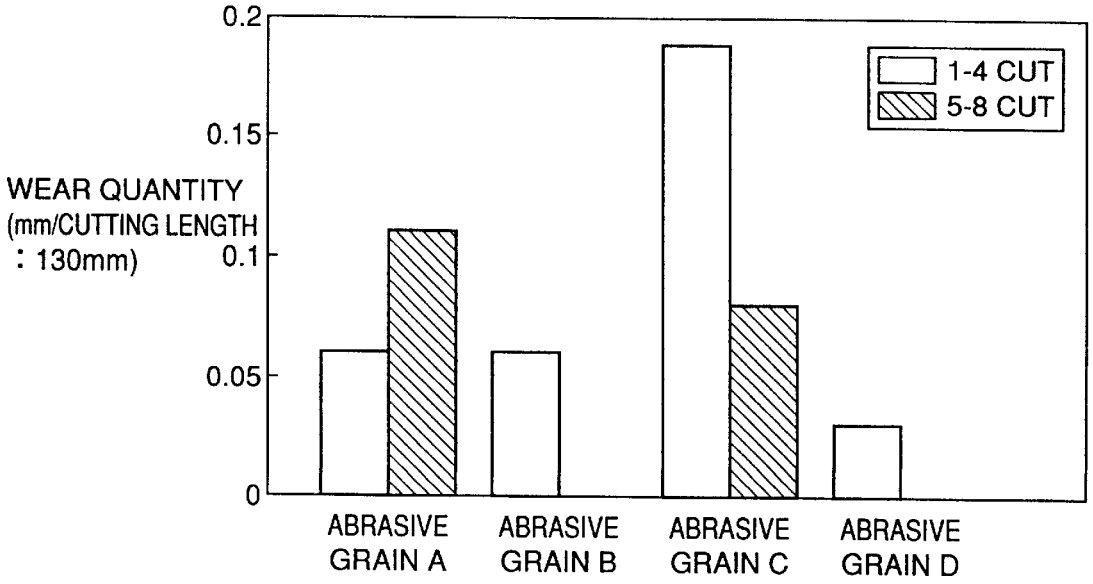
FIG. 8 is a diagram showing wear quantities for the types of diamond abrasive grains in Example 1.

FIG. 7 shows results obtained by measuring perforation times relative to perforation counts for each type of the employed diamond abrasive grains. FIG. 8 shows results obtained by measuring wear quantities for each type of the employed diamond abrasive grains. Referring to FIG. 7, the cutting length per count in the respective perforation counts is 130 mm, and the perforation time shows the time taken when forming a hole of 130 mm in length. Referring to FIG. 8, bar graphs not hatched show mean values of wear quantities in perforation of one to four times, and hatched bar graphs show mean values of wear quantities in perforation of five to eight times.

As obvious from FIG. 7 and FIG. 8, the perforation times were long and cutting was disabled with perforation of several times when making the perforation test with the core bits employing the diamond abrasive grains B and D. When observing forward end surfaces of the diamond abrasive grains after perforation, traces of crushing were observed, while the forward end surfaces of the diamond abrasive grains concerned in cutting were roundly worn.

On the other hand, the core bits employing the diamond abrasive grains A and C exhibited a short perforation time, i.e., a high perforation speed in each perforation count, were capable of withstanding continuous use and usable until the diamond tips disappeared. It is understood that the core bit employing the diamond abrasive grain A was most excellent with the wear quantity per perforating operation smaller than that in the core bit employing the diamond abrasive grain C as the mean value.

Impurities contained in the employed four types of diamond abrasive grains were chemically analyzed. Further, measurements of toughness indices TI under a normal temperature and toughness indices TTI (1100° C.) under a high temperature were performed as to the four types of diamond abrasive grains. Table 1 shows results of these measurements.

TABLE 1

| Diamond Abrasive Grain | A | B | C | D |
|---|---|---|---|---|
| Main Component of Solvent metal Inclusion (wt %) | Fe-Ni | Fe-Ni | Fe-Ni | Fe-Co |
| Fe | 0.015 | 0.018 | 0.006 | 0.042 |
| Ni | 0.004 | 0.008 | 0.004 | <0.001 |
| Co | <0.001 | <0.001 | <0.001 | 0.052 |
| Cr | 0.004 | 0.004 | 0.004 | 0.002 |
| Mn | <0.001 | <0.001 | <0.001 | <0.001 |
| Total | 0.025 | 0.032 | 0.017 | 0.098 |
| Toughness Index[TI] (%) | 86 | 84 | 87 | 81 |
| High-Temperature Toughness Index [TTI(1100° C.)] (%) | 82 | 81 | 83 | 72 |

As obvious from Table 1, the diamond abrasive grain D is at the lowest value as to the toughness index TTI (1100° C.) under a high temperature having been employed as the selection method for diamond abrasive grains in general. Observing the measurement result in FIG. 7 as to the diamond abrasive grain D, the perforation time is long, and the wear quantity is small observing the measurement result in FIG. 8. This indicates that forward end surfaces of the diamond abrasive grains involved in cutting wore easily and immediately lost working ability for serving as a cutting edge, and cutting was disabled with perforation of several times.

In the diamond abrasive grains A, B and C, on the other hand, significant differences were hardly observed between the values of the toughness indices TTI (1100° C.) under the high temperature, as obvious from Table 1. However, the diamond abrasive grain B had a large content of inclusion, and hence the core bit employing the diamond abrasive grain B exhibited a result similar to that of the core bit employing the diamond abrasive grain D, as shown in FIG. 7. Thus, it has been recognized that, if the content of inclusions in diamond abrasive grains is not more than 0.03 weight % and the main components of solvent metals employed in preparation of the diamond abrasive grains are iron (Fe)—nickel (Ni), the perforation time is short, i.e., the perforation speed is high, and the wear quantity is small when carrying out perforation with a core bit employing the diamond abrasive grains.

EXAMPLE 2

Core bits were prepared similarly to Example 1. A in Table 1 was employed for diamond abrasive grains. In Example 2, the performance of the core bits was investigated by varying compositions of metal bonds serving as binders for bonding the diamond abrasive grains to each other. As the compositions of the metal bonds, three types of compositions I, II and III shown in Table 2 were employed.

TABLE 2

| Element Forming | Blending Composition (wt %) | | |
|---|---|---|---|
| Metal Bond | Composition I | Composition II | Composition III |
| Graphite (C) | | | 0.5 |
| Cobalt (Co) | 50.0 | 30.0 | 19.5 |
| Nickel (Ni) | | 35.0 | 10.0 |
| Tin (Sn) | 5.0 | 14.0 | 14.0 |
| Copper (Cu) | 25.0 | 21.0 | 56.0 |
| Tungsten (W) | 20.0 | | |

The physical properties of each sintered body obtained by sintering material powder of each metal bond were investigated. Table 3 shows the measurement results.

TABLE 3

| | Blending Composition (wt %) | | |
|---|---|---|---|
| Evaluated Item | Composition I | Composition II | Composition III |
| Hardness (HRB) | 105 | 102 | 99 |
| Transverse Rupture Strength (kgf/mm$^2$) | 72 | 62 | 45 |

Referring to Table 2 and Table 3, the composition I is the composition of a metal bond generally employed in a commercially available product, and mainly composed of tungsten (W) and cobalt (Co). The cobalt does not contribute to improvement of brittleness, although the same contributes to increase holding power of the metal bond holding diamond abrasive grains and to increase toughness too. The composition II is that for forming a metal bond having both hardness and brittleness by replacing part of cobalt with nickel (Ni) in the composition I, adding tin (Sn) and forming an intermetallic compound of nickel (Ni)—tin (Sn). The composition III has a composition obtained by adding nickel and tin to a soft bronze bond composition for forming an intermetallic compound of Ni—Sn and adding graphite for the purpose of producing carbon dioxide during perforation and for the purpose of improvement of solid lubricity.

Three types of core bits were prepared with the metal bonds of the aforementioned three types of compositions similarly to Example 1. The degree of concentration of the diamond abrasive grains was similar to that in Example 1. The specifications of the core bits and a perforation apparatus were also similar to those in Example 1.

A test of boring a workpiece similar to that in Example 1 was made with the three types of core bits.

Figure 6A:
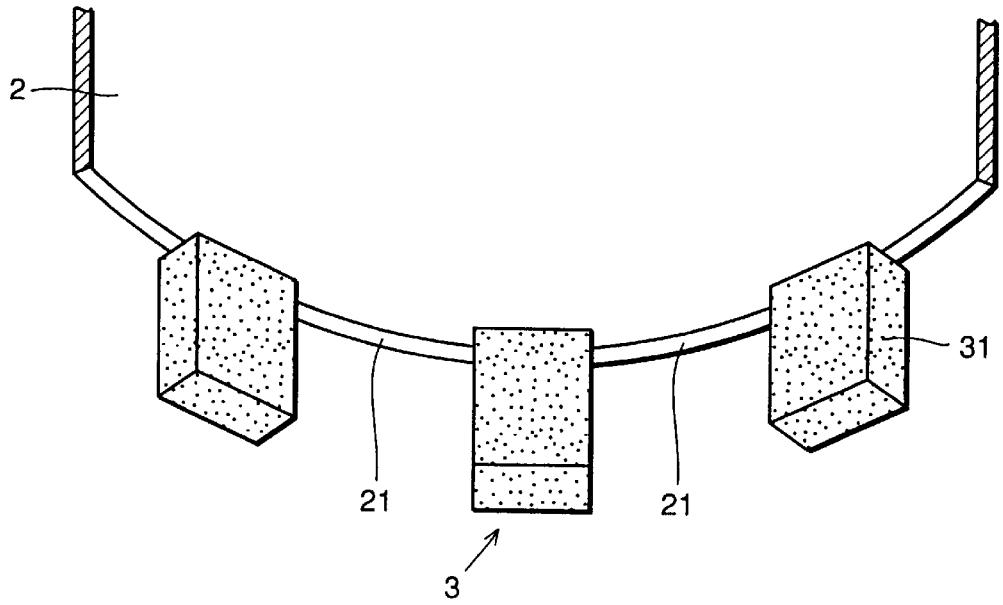
FIG. 6A is a partially enlarged perspective view showing an exemplary mode of mounting diamond tips on a tube.
Figure 6B:
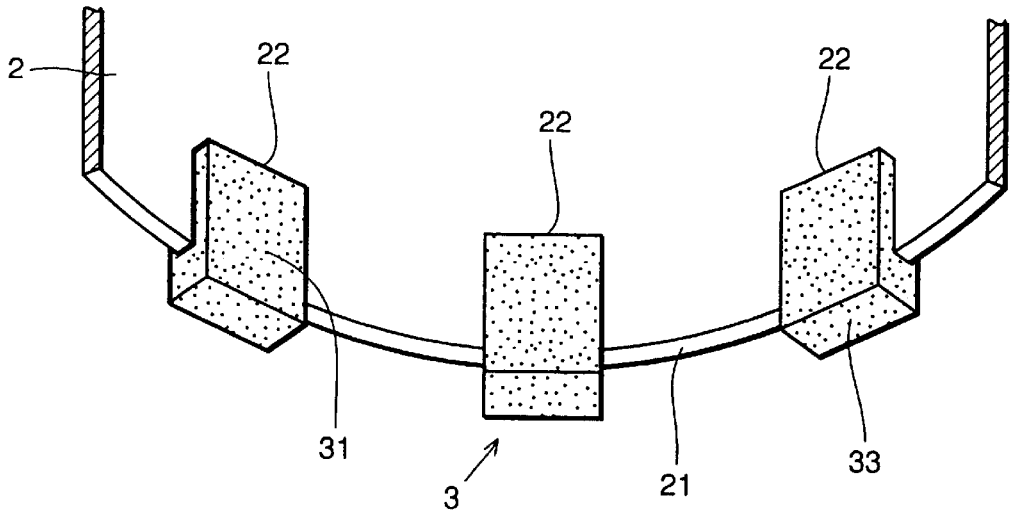
FIG. 6B is a partially enlarged perspective view showing another exemplary mode of mounting diamond tips on a tube.

The tip mounting mode shown in FIG. 6B was employed for the core bit employing the metal bond of the composition III, and the tip mounting mode shown in FIG. 6A was employed for the remaining core bits employing the compositions I and II.

In the core bit employing the tip mounting mode shown in FIG. 6B, the amount of projection of the forward end surfaces 33 of the diamond tips 3 from the opening end surface 21 of the tube was set at 1.5 mm. It was confirmed that the core bit can continuously perform perforation with such a small tip projection amount. The core bit can continuously perform perforation even if the tips are so worn by perforation that the forward end surfaces of the tips are positioned on the same plane as the opening end surface of the tube conceivably because a small step is present between diamond abrasive grains newly exposed due to autogenous action of the diamond abrasive grains.

Table 4 shows measurement results of perforation times and wear quantities.

TABLE 4

| | Composition I | Composition II | Composition III |
|---|---|---|---|
| Perforation Time (sec/cut) | uncuttable with 4 cut | uncuttable with 2 cut | 340 ~ 370 |
| Wear Quantity (mm/cut) | 0.01 ~ 0.05 | 0.03 ~ 0.06 | 0.04 ~ 0.14 |

As obvious from Table 4, the metal bonds were worn and retreated in such small amounts that clogging was caused in two to four perforation times to disable cutting in the composition I and the composition HI. In the core bit employing the metal bond of the composition m, on the other hand, it was possible to continuously perform perforation, and the core bit could perform cutting until the diamond tips were lost. In the core bit employing the metal bond of the composition III, further, the perforation time was short, i.e., the perforation speed was high, and sharpness was excellent.

Then, the influence of the content amount of graphite was investigated by performing the perforation test under the same conditions while varying the content of graphite in the composition III of the metal bond shown in Table 2. The specifications (the particle size and the degree of concentration of diamond) of diamond tips, the specifications of core bits and a perforation apparatus, and the specifications of workpieces were rendered identical to the aforementioned test conditions. The grain size of the employed graphite was 6 $\mu$m, and the grain size of diamond abrasive grains was 600 to 425 $\mu$m.

Figure 9:
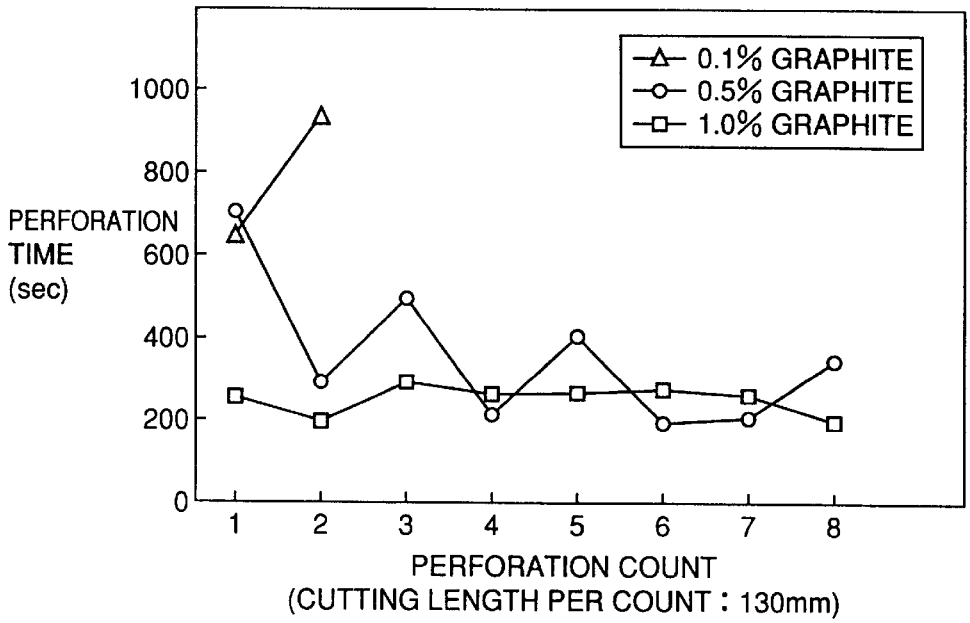
FIG. 9 is a diagram showing perforation times changing with perforation counts for the graphite content in the metal bonds in Example 2.
Figure 10:
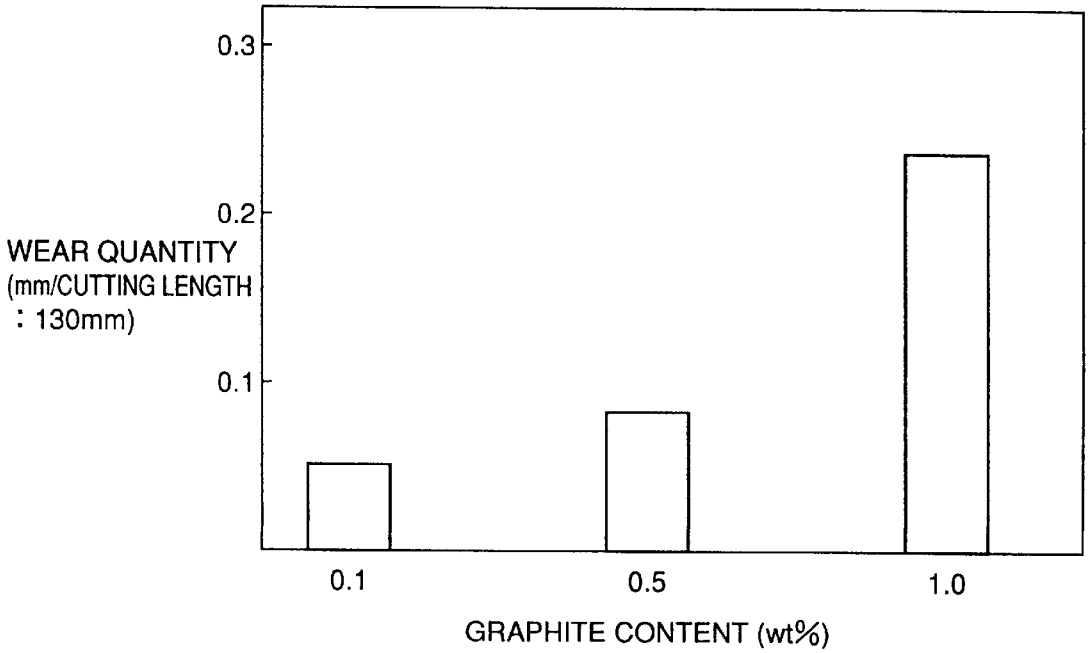
FIG. 10 is a diagram showing wear quantities for the graphite content in the metal bonds in Example 2.

FIG. 9 and FIG. 10 show measurement results of perforation times and wear quantities.

As obvious from FIG. 9 and FIG. 10, it is understood that the wear quantity increases as the content of graphite in the metal bond increases although the perforation time is short, i.e., the perforation speed is high and sharpness is excellent.

When the content of graphite was 2.0 weight %, the wear quantity was remarkably dispersed in the range of 1.1 to 1.6 mm. When the content of graphite exceeded 2.0 weight %, further, the wear quantity abruptly increased and cracking was caused on the diamond tips.

When the metal bond contained no graphite or the content of graphite in the metal bond was less than 0.1 weight %, there were some cases where the forward end surfaces of the diamond tips involved in cutting blackened and seizure resulted. When seizure occurred, the wear quantity abruptly increased, cutting was finally disabled, and it was impossible to continue perforation.

Further, core bits were prepared as to such cases where the grain sizes of graphite were 100 $\mu$m and 6 $\mu$m, and a perforation test was made similarly to the above. At this time, the content of graphite was 0.5 weight %. When observing the forward end surfaces of the diamond tips after perforation, depressions substantially identical in size to the grain size of graphite were found on the surface of the metal bond. When the grain size of graphite was 100 $\mu$M, depressions substantially identical in size to the graphite grain size formed on the surface of the metal bond acted similar to chip pockets and the perforation speed was high, i.e., sharpness was excellent, while the wear quantity increased and cracking was caused on the diamond tips. When the grain size of graphite was 6 $\mu$m, it was observed that fine depressions were distributed on the overall surface of the metal bond, blacked and oxidized. Thus, it is understood that fine grains of graphite serve as a solid lubricant and define a generation source for carbon dioxide.

EXAMPLE 3

Eight types of core bits were prepared as shown in Table 5 by employing the diamond abrasive grain A in Table 1 as diamond abrasive grains and the composition m in Table 2 as the composition of metal bonds and varying degrees of concentration of the diamond abrasive grains, numbers of tips fixed to opening end surfaces of tubes and the lengths of the tips. The particle size of the diamond abrasive grains, the specifications of the core bits and a perforation apparatus and the specifications of workpieces were rendered similar to those in Example 1.

A perforation test was made with the eight types of core bits, for observing sharpness and situations of wear. Table 5 shows the results.

TABLE 5

| Sample No. | 1 | 2 | 3 | 4 | 5 | 6 | 7 | 8 |
|---|---|---|---|---|---|---|---|---|
| Core Bit Specification | | | | | | | | |
| Degree of Concentration | 57 | 57 | 57 | 45 | 34 | 25 | 34 | 34 |
| Tip Number (n) | 14 | 10 | 6 | 14 | 14 | 14 | 14 | 14 |
| Tip Length (l) (mm) | 4 | 4 | 4 | 4 | 4 | 4 | 5 | 3 |
| Product (n × l) (mm) | 56 | 40 | 24 | 56 | 56 | 56 | 70 | 42 |
| Tip Occupation Rate | 30 | 21 | 13 | 30 | 30 | 30 | 37 | 22 |
| Test Result | | | | | | | | |
| Sharpness | x | ◎ | ◎ | x | ○ | ○ | Δ | ○ |
| Wear Quantity (mm/cut) | — | attrited with 2 cuts | attrited with 1 cut | — | 0.10 | 0.60 | 0.07 | 0.17 |

Referring to Table 5, marks shown on the row labeled "sharpness" indicate the following states respectively:

◎: Cuts well but remarkably worn.

○: The perforation speed is high.

Δ: The perforation speed is slightly low as compared with 0.

x: perforation impossible

Referring to Table 5, the tip occupation rate was calculated through the following expression:

(Tip Occupation Rate)={(Product)/(Circumferential Length of Opening End Surface of Tube)}×100 (%)

As evident from Table 5, the sample numbers 1 and 4 having high degrees of concentration and high tip occupation rates instantaneously clogged after starting perforation, and were incapable of cutting. Further, it was recognized that the wear quantity was remarkable and the life was short although the sharpness was excellent when the tip occupation rate was small as in the sample numbers 2 and 3 even if the degree of concentration was high. Therefore, the ranges of the specifications of the core bit employed for boring a hard material such as reinforced concrete in a dry type are shown in sample numbers 5 to 8, and it is conceivably preferable that the degree of concentration of diamond abrasive grains and the tip occupation rate are in the ranges of 20 to 40 and 22 to 37% as shown in sample numbers 5 to 8.

If the workpiece is a soft concrete structure such as mortar, the ranges of specifications of the core bit enlarge, as a matter of course.

EXAMPLE 4

A perforation test was made with core bits of 60 mm in bore diameter on three types of structures of mortar, concrete containing aggregate and reinforced concrete as workpieces. Two types of core bits of the inventive sample and a conventional sample were employed.

In the core bit of the inventive sample, the diamond abrasive grain A in Table 1 was employed as diamond abrasive grains, and the grain size of the diamond abrasive grains was 600 to 425 μm. The composition III in Table 2 was employed as the composition of a metal bond, and the grain size of graphite contained in the metal bond was 6 μm. The degree of concentration of the diamond abrasive grains in abrasive grain layers was 30.0. The number of diamond tips fixed to an opening end surface of a tube was 14. The dimensions (length along circumferential direction of opening end surface of tube)×(thickness)×(height) of the tips were 4.0×3.5×6.0 (mm).

In the core bit of the conventional sample, on the other hand, the dimensions of tips were 6.0×3.0×5.0 (mm), and the number of the tips fixed to an opening end surface of a tube was 12.

The core bits of the inventive sample and the conventional sample were mounted on a perforation apparatus of similar specifications as those in Example 1, for performing a perforation test of forming a hole of 100 mm in depth.

Figure 11A:
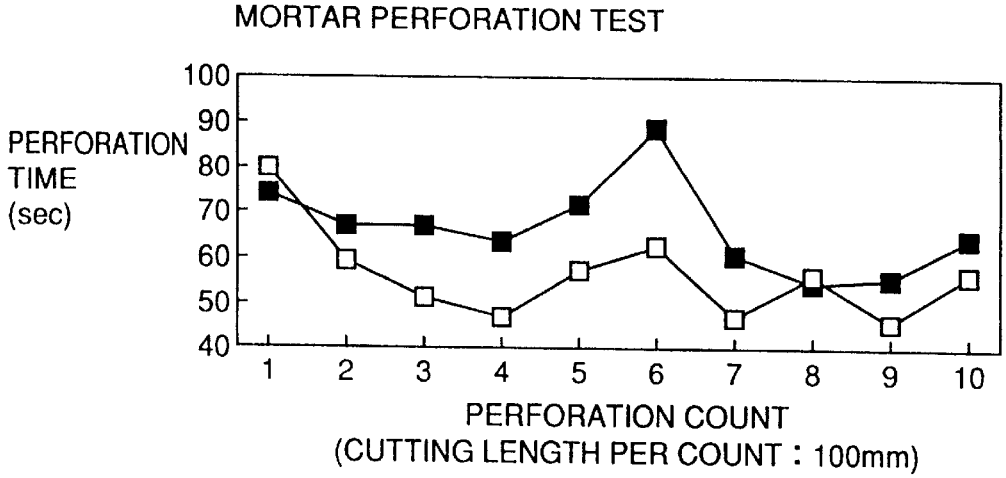
FIG. 11A, FIG. 11B and FIG. 11C are diagrams showing perforation times changing with perforation counts for the workpieces in Example 4.
Figure 11B:
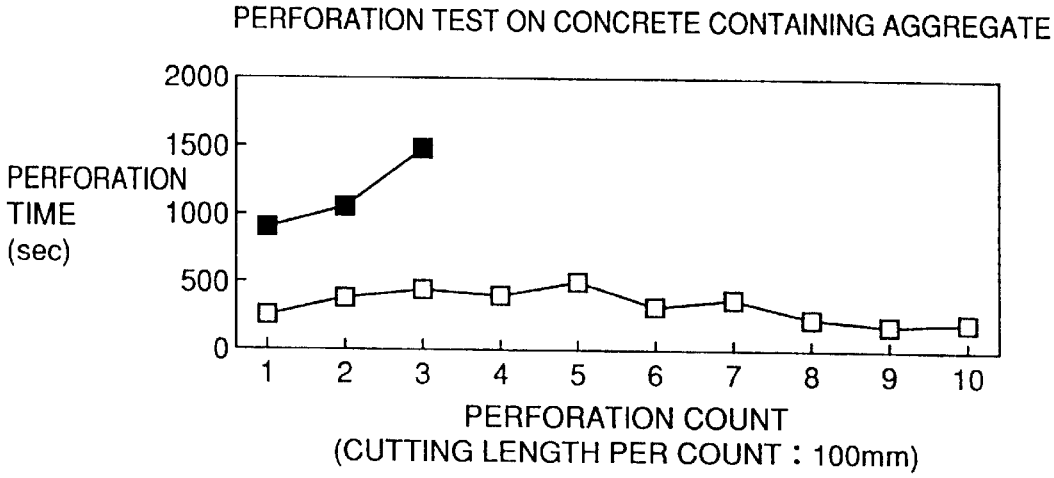
Figure 11C:
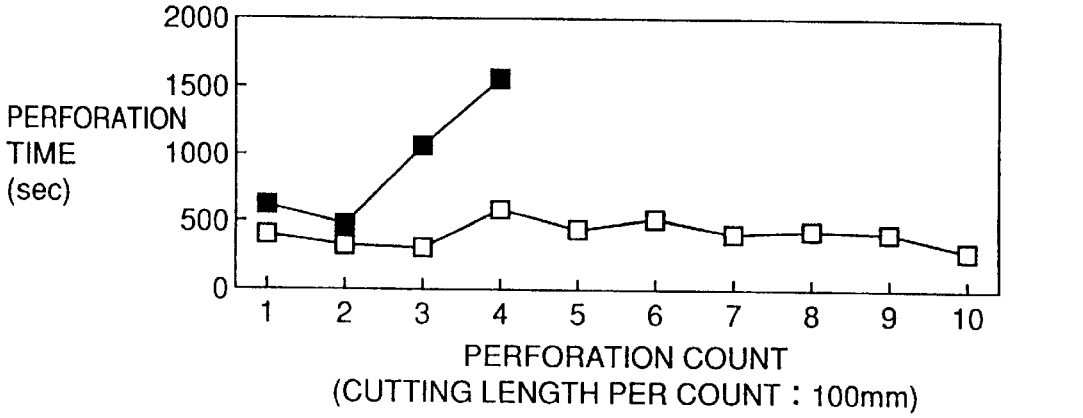

Measurement results of perforation times are shown in FIG. 11A, FIG. 11B and FIG. 11C for each workpiece. Table 6 shows measurement results of the wear quantity for each workpiece. Referring to FIG. 11A to FIG. 11C, □ and ■ indicate measured data of the inventive sample and the conventional sample, respectively. Referring to Table 6, the wear quantity of the conventional sample is the wear quantity when forming a hole of 100 mm in depth through single perforation, and indicates the mean value before the core bits become unable to cut. The wear quantity of the inventive sample is the wear quantity when of forming a hole of 100 mm in depth through single perforation and indicates the mean value.

TABLE 6

| Workpiece | Wear Quantity of Inventive Sample (mm) | Wear Quantity of Conventional Sample (mm) |
|---|---|---|
| Mortar (Pressure Resistance 255 kgf/cm$^2$) | 0.06 | 0.05 |
| Containing Aggregate (Pressure Resistance 255 kgf/cm$^2$) | 0.02 | 0.04 |
| Reinforced Concrete (Pressure Resistance 350 kgf/cm$^2$) | 0.17 | 0.10 |

As evident from these measurement results, cutting was disabled with perforation of three to four times with respect to hard concrete containing aggregate or reinforced concrete when employing the core bit of the conventional sample, although it was possible to bore soft mortar. When employing the core bit of the inventive sample, on the other hand, autogenous action of the diamond abrasive grains occurred and it was possible to continuously carry out perforation even completing perforations 10, and the sharpness was also excellent.

EXAMPLE 5

Core bits (sample numbers 9 to 11) having diamond tips formed by only abrasive grain layers and core bits (sample numbers 12 to 17) having diamond tips formed by abrasive grain layers and holding layers were prepared. The bore diameter of the core bits was 60 mm.

Figure 12:
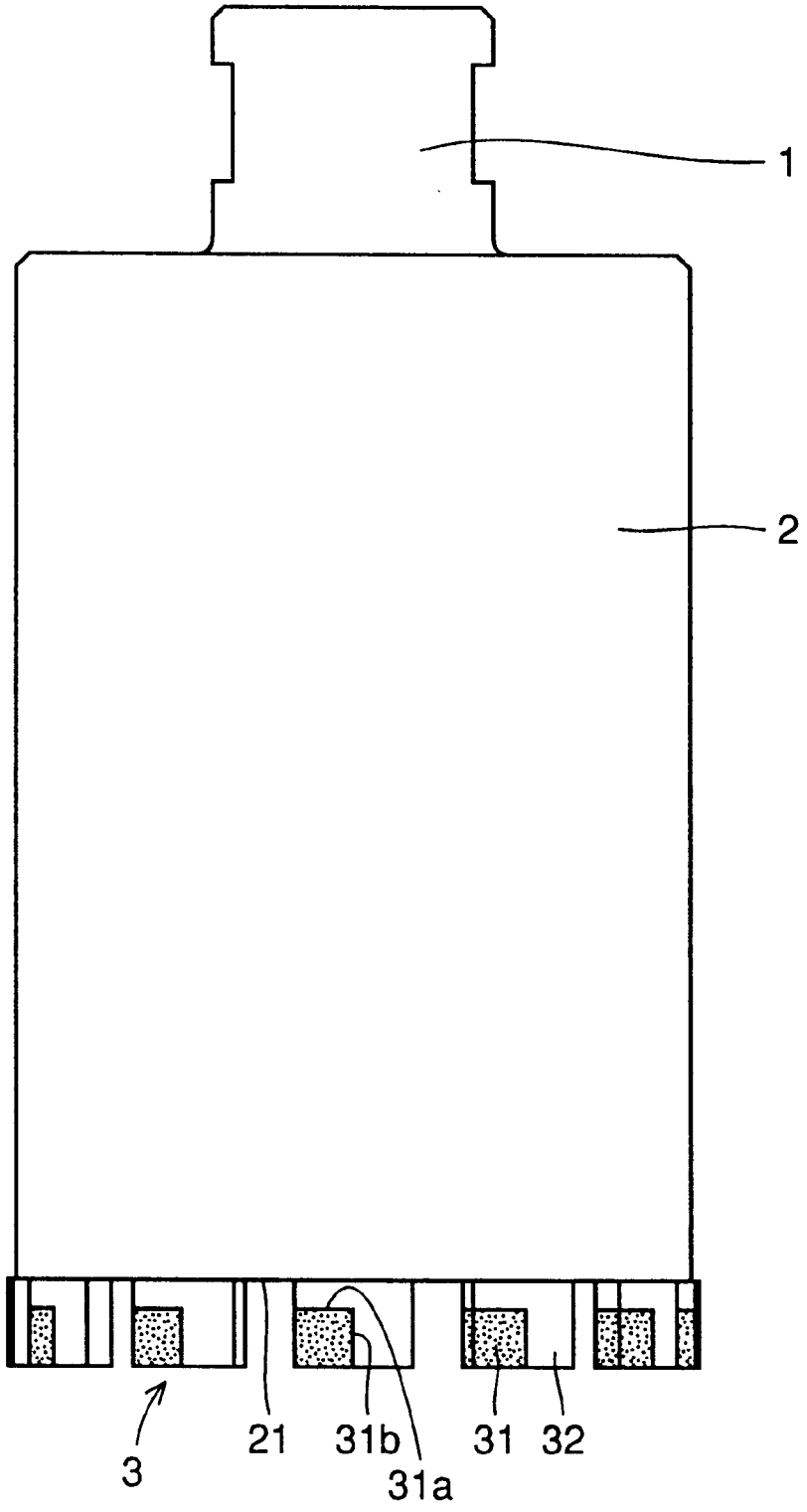
FIG. 12 is a side elevational view showing another embodiment of a core bit according to the present invention.
Figure 13:
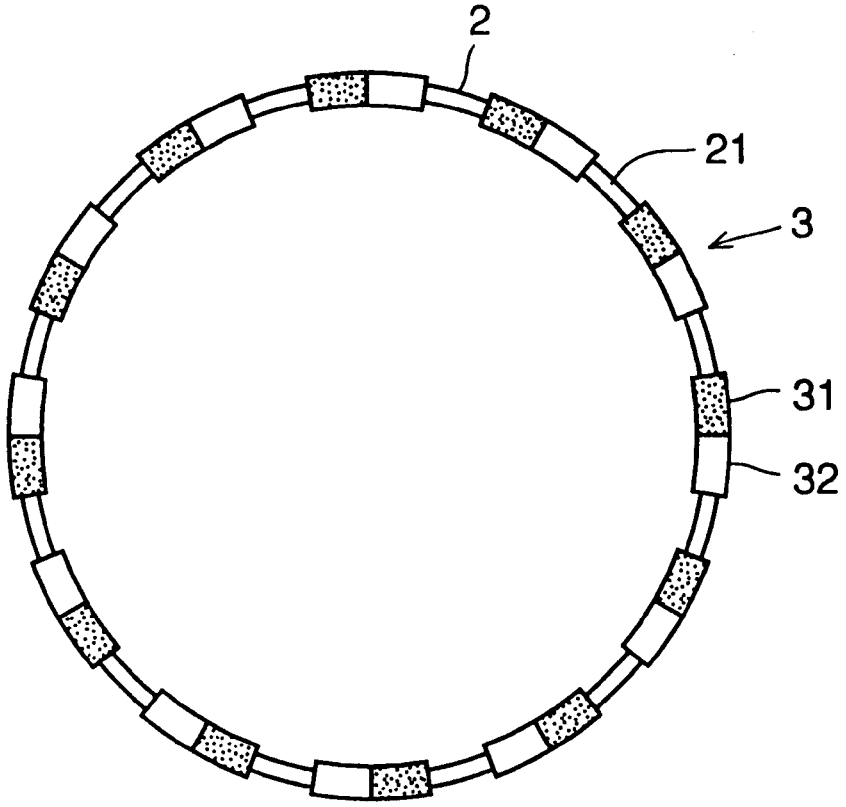
FIG. 13 is an end view showing a forward end portion of the core bit shown in FIG. 12.

In the core bits of the sample numbers 9 to 11, the tip embed type was employed as shown in FIG. 4 and FIG. 5. In the core bits of the sample numbers 12 to 17, the tip projection type was employed as shown in FIG. 12 and FIG. 13. As shown in FIG. 12 and FIG. 13, diamond tips 3 are formed by abrasive grain layers 31 and holding layers 32 holding the abrasive grain layers 31. The abrasive grain layers 31 have first end surfaces 31*a* positioned in the axial direction of a tube 2, i.e. extending perpendicularly to the axial direction, and second end surfaces 31*b* positioned in the circumferential direction of an opening end surface 21 of the tube 2, i.e. extending respectively perpendicularly to the circumferential direction. The holding layers 32 are fixed to the first end surfaces 31*a* and the second end surfaces 31*b* of the abrasive grain layers 31. The diamond tips 3 thus formed are fixed to the opening end surface 21 of the tube 2.

In the core bits of the sample numbers 9 to 17, the diamond abrasive grain A in Table 1 was employed for diamond abrasive grains. As to the composition of metal bonds serving as binders for bonding the diamond abrasive grains to each other, the composition III in Table 2 was employed. The grain size of graphite contained in the metal bonds was 6 $\mu$m. The grain size of the diamond abrasive grains was 600 to 425 $\mu$m. The degree of concentration of the diamond abrasive grains in the abrasive grain layers was 30.0.

In the core bit of the sample number 9, the dimensions length×thickness×height) of the diamond tips, i.e., the abrasive grain layers were 4.0×3.5×6.0 (mm), and 12 diamond tips were arranged along the circumferential direction of the opening end surface of the tube. Therefore, the tip occupation rate, i.e., the abrasive grain layer occupation rate was 25.5%.

In the core bit of the sample number 10, the dimensions of the diamond tips, i.e., the dimensions (length×thickness×height) of the abrasive grain layers were 5.0×3.5×6.0 (mm), and 12 diamond tips were arranged along the circumferential direction of the opening end surface of the tube. Therefore, the tip occupation rate, i.e., the abrasive grain layer occupation rate was 31.8%.

In the core bit of the sample number 11, the dimensions of the diamond tips, i.e., the dimensions (length×thickness×height) of the abrasive grain layers were 6.0×3.5×6.0 (mm), and 12 diamond tips were arranged along the circumferential direction of the opening end surface of the tube. Therefore, the tip occupation rate, i.e., the abrasive grain layer occupation rate was 38.2%.

In the core bits of the sample numbers 12 to 17, the dimensions (length×thickness×height) of the abrasive grain layers were 6.0×3.5×6.0 (mm). Therefore, the abrasive grain layer occupation rate was 38.2 %. In the core bits of the sample numbers 12 to 17, the diamond tips were formed by abrasive grain layers and holding layers, and hence the tip occupation rates varied with the lengths of the holding layers respectively. The occupation rates of the tips were made different from each other by varying the lengths of the holding layers as shown in Table 7. 12 diamond tips were arranged along the circumferential direction of the opening end surface of the tube. The holding layers were formed to contain cobalt (Co) by 70 weight % and iron (Fe) by 30 weight %. The abrasive grain layers and the holding layers were integrated with each other by sintering.

The core bits of the sample numbers 9 to 17 were prepared by fixing the diamond tips prepared in the aforementioned manner to opening end surfaces of tubes by brazing. A perforation test of forming holes of 100 mm in reinforced concrete as workpieces was made with these core bits.

In the composition of the holding layers, cobalt contributed to improve transverse rupture strength, and 30 weight % of iron was contained for the purpose of having the same sintering temperature as that for the abrasive grain layers.

Figure 14:
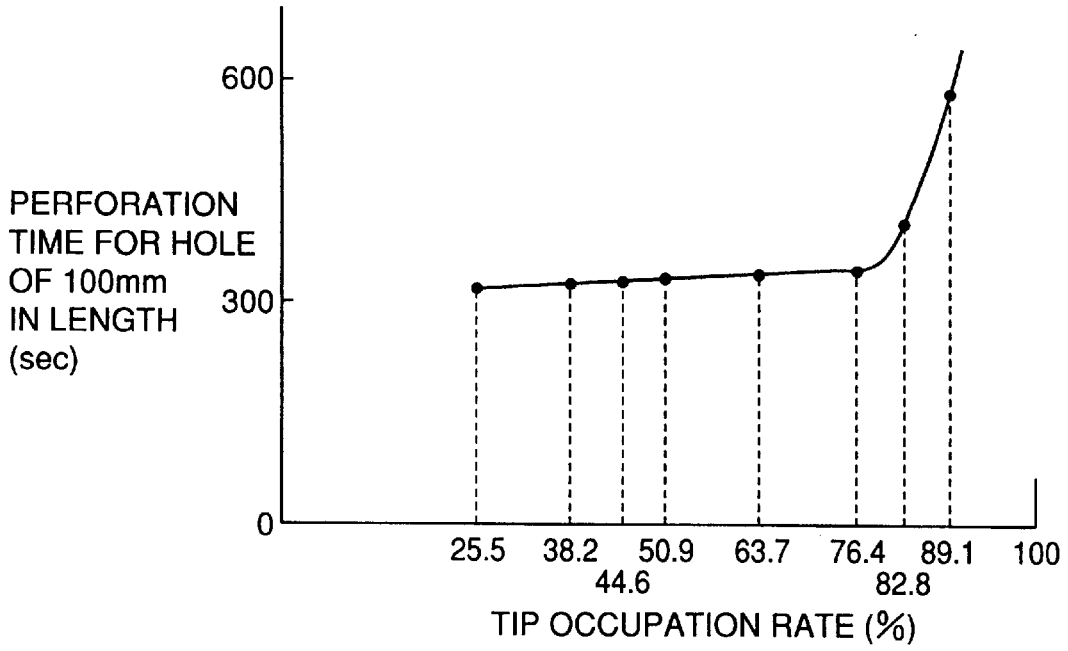
FIG. 14 is a diagram showing the relation between tip occupation rates and perforation times in Example 5.
Figure 15:
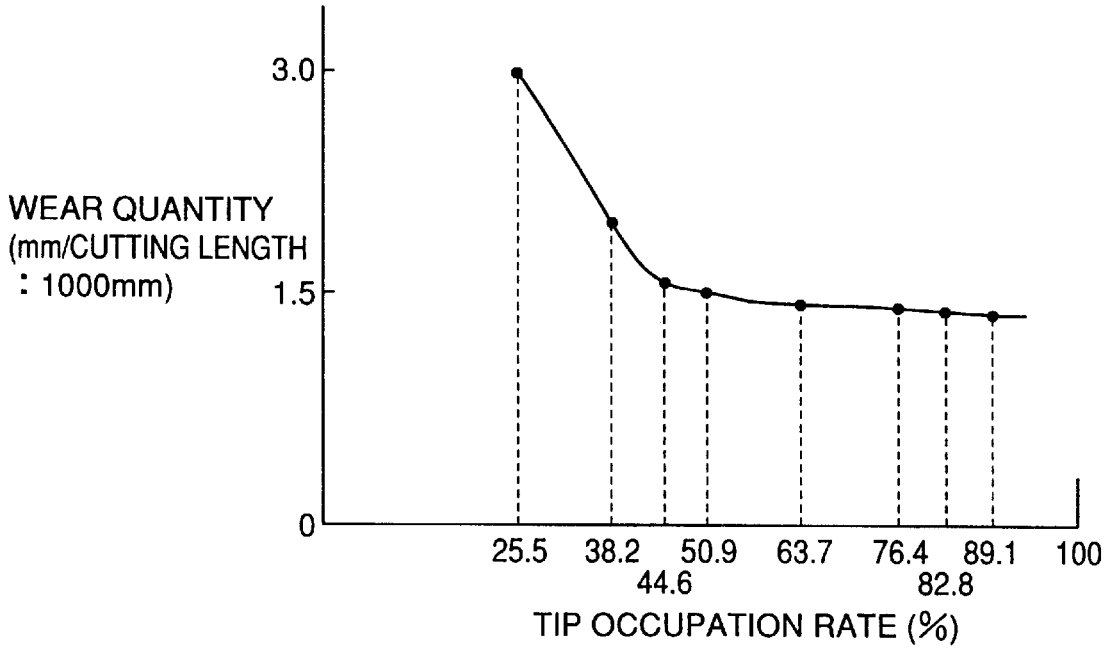
FIG. 15 is a diagram showing the relation between tip occupation rates and wear quantities in Example 5.

FIG. 14 shows measurement results of perforation times for each tip occupation rate. FIG. 15 shows measurement results of wear quantities for each tip occupation rate. Further, Table 7 shows measurement results of sharpness, life and vibration of each sample number.

TABLE 7

| Sample No. | 9 | 10 | 11 | 12 | 13 | 14 | 15 | 16 | 17 |
|---|---|---|---|---|---|---|---|---|---|
| Holding Layer Length (mm) | 0 | 0 | 0 | 1 | 2 | 4 | 6 | 7 | 8 |
| Tip Length (mm) | 4 | 5 | 6 | 7 | 8 | 10 | 12 | 13 | 14 |
| Tip Occupation Ratio (%) | 25.5 | 31.8 | 38.2 | 44.6 | 50.9 | 63.7 | 76.4 | 82.8 | 89.1 |
| Result | | | | | | | | | |
| Sharpness | ○ | ○ | ○ | ○ | ○ | Δ | Δ | x | x |
| Life | x | Δ | ○ | ○ | ○ | ○ | ○ | ○ | ○ |
| Vibration (Touch) | x | x | Δ | ○ | ○ | ○ | ○ | ○ | ○ |

As evident from the measurement results, it is understood that the sharpness deteriorates and the peiforation time lengthens when the tip occupation rate exceeds 80%. Further, it is understood that vibration and the wear quantity increase when the tip occupation rate is less than 40%. From this, it is understood that vibration generated while cutting a reinforcing bar can be suppressed by reinforcing the abrasive grain layers having low transverse rupture strength forming the diamond tips with the abrasive grain layers and the holding layers with the holding layers having high transverse rupture strength and increasing the tip occupation rate. The transverse rupture strength of the metal bond in the abrasive grain layers was 45 kgf/mm$^2$, and the transverse rupture strength of the holding layers was 90 kgf/mm$^2$.

All embodiments and Examples described above are illustratively shown and to be considered as not restrictive. The scope of the present invention is shown not by the aforementioned embodiments and Examples but by the scope of the appended claims, and to be interpreted as including all corrections and modifications within the meaning and range equivalent to the scope of the claims.

As hereinabove described, the core bit according to the present invention has a short perforation time, i.e., a high cutting speed, exhibits excellent sharpness, is excellent in durability, and has a long life. Further, the core bit according to the present invention can ensure strength of tips, and can effectively prevent vibration generated when cutting a reinforcing bar or the like particularly in case of boring reinforced concrete. Therefore, the core bit according to the present invention is applicable as a general-purpose tool for boring concrete structures having different properties over a wide range from soft mortar to hard concrete containing aggregate and further to reinforced concrete. The core bit according to the present invention is effective not only for a dry type operation but also for a wet type.

What is claimed is:

1. A core bit comprising:

a tube (2) extending in an axial direction and terminating in said axial direction at an end of said tube, wherein said end has an opening end surface (21); and a plurality of tips (3) fixed to said opening end surface (21) of said tube (2), wherein each one of said tips (3) includes an abrasive grain layer (31) that comprises diamond abrasive grains and a binder bonding said diamond abrasive grains to each other, wherein said diamond abrasive grains contain diamond and not more than 0.03 weight % of inclusions, which contain iron and nickel as main components thereof, and wherein said binder contains at least 0.1 weight % and not more than 2.0 weight % of graphite.

2. The core bit in accordance with claim 1, wherein said diamond abrasive grains have a diamond particle size, and said graphite consists of graphite particles having a graphite particle size that is not more than 1/10 of said diamond particle size.

3. The core bit in accordance with claim 1, wherein said binder further contains at least 15.0 weight % and not more than 50.0 weight % of an intermetallic compound of nickel-tin.

4. The core bit in accordance with claim 3, wherein said opening end surface (21) of said tube (2) has a plurality of concave parts (22), and each one of said tips (3) is fixed to a respective one of said concave parts (22).

5. The core bit in accordance with claim 4, wherein each one of said tips respectively has an end surface (33) that projects by not more than 3.0 mm beyond said opening end surface (21) of said tube (2).

6. The core bit in accordance with claim 3, wherein said binder further contains copper, tin, nickel and cobalt.

7. The core bit in accordance with claim 1, wherein said opening end surface extends circumferentially with an end surface circumferential length in a circumferential direction around an axis that extends in said axial direction, wherein each one of said tips has a circumferential tip length along said circumferential direction, wherein a degree of concentration of said diamond abrasive grains in said abrasive grain layer (31) is at least 20 and not more than 40, and wherein a tip occupation rate defined by {(said circumferential tip length)×(a total number of said tips)/(said end surface circumferential length)}×100% is at least 15% and not more than 40% in said core bit having a perforation diameter perpendicular to said axis of at least 10.0 mm and not more than 150.0 mm.

8. The core bit in accordance with claim 7, wherein said tip occupation rate is at least 22% and not more than 37%.

9. The core bit in accordance with claim 1, wherein each one of said tips (3) further includes a holding layer (32) holding said abrasive grain layer (31).

10. The core bit in accordance with claim 9, wherein said opening end surface extends circumferentially in a circumferential direction around said axial direction, wherein said abrasive grain layer (31) has a first end surface (31*a*) extending perpendicular to said axial direction of said tube (2) and a second end surface (31*b*) extending perpendicular to said circumferential direction, and wherein said holding layer (32) is fixed to said first and second end surfaces.

11. The core bit in accordance with claim 9, wherein said holding layer (32) and said binder respectively have different compositions relative to each other, and wherein said holding layer has a relatively higher transverse rupture strength and said abrasive grain layer (31) has a relatively lower transverse rupture strength relative to each other.

12. The core bit in accordance with claim 11, wherein said holding layer (32) contains cobalt or nickel.

13. The core bit in accordance with claim 9, wherein said opening end surface extends circumferentially with an end surface circumferential length in a circumferential direction around said axial direction, wherein each one of said tips has a circumferential tip length along said circumferential direction, and wherein a tip occupation rate defined by {(said circumferential tip length)×(a total number of said tips)/(said end surface circumferential length)}×100% is at least 40% and not more than 80%.

14. The core bit in accordance with claim 13, wherein said tip occupation rate is at least 44.6% and not more than 76.4%.

15. The core bit in accordance with claim 1, wherein said diamond abrasive grains contain a positive amount of said inclusions.

16. The core bit in accordance with claim 15, wherein said diamond abrasive grains contain not more than 0.025 weight % of said inclusions.

17. The core bit in accordance with claim 1, wherein said inclusions do not contain a combination of iron and cobalt, and do not contain a combination of nickel and manganese.

18. The core bit in accordance with claim 1, wherein said diamond abrasive grains have a grain size of 300 to 425 μm.

19. The core bit in accordance with claim 1, wherein said diamond abrasive grains have a grain size of 425 to 600 μm.

20. The core bit in accordance with claim 1, wherein said diamond abrasive grains have a high-temperature toughness index measured at 1100° C. (TTI (1100° C.)) of at least 82.

* * * * *

UNITED STATES PATENT AND TRADEMARK OFFICE

CERTIFICATE OF CORRECTION

PATENT NO. : 6,192,875 B1
DATED : February 27, 2001
INVENTOR(S) : Koroku et al.

It is certified that error appears in the above-identified patent and that said Letters Patent is hereby corrected as shown below:

FOREIGN PATENT DOCUMENTS,
In the third Japanese patent listed, (3-84110), replace "8/1990" by -- 8/1991 --;

Column 2,
Line 49, after "result," insert -- the --;

Column 3,
Line 19, after "may", replace "causes" by -- cause --;

Column 5,
Line 32, after "retreats", replace "," by -- ; --;
Line 55, after "diamond", replace "tips" by -- tip --;

Column 8,
Line 53, after "FIG.", replace "GA" by -- 6A --;

Column 11,
Line 53, after "composition" (second occurrence), replace "HI" by -- II --;
Line 54, after "composition", replace "m" by -- III --;

Column 12,
Line 56, after "composition", replace "m" by -- III --;

Column 13,
Line 25, replace "0" by -- O --;
Line 35, after "short", insert -- , --;
Line 36, after "excellent", insert -- , --;

UNITED STATES PATENT AND TRADEMARK OFFICE

CERTIFICATE OF CORRECTION

PATENT NO. : 6,192,875 B1
DATED : February 27, 2001
INVENTOR(S) : Koroku et al.

It is certified that error appears in the above-identified patent and that said Letters Patent is hereby corrected as shown below:

Column 14,
Line 38, after "when", delete -- of --;
Line 61, after "perforation", insert -- , --;

Column 15,
Line 45, before "length", insert -- ( --;

Column 17,
Line 8, after "wet type" insert -- operation --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*